US008822119B2

(12) United States Patent
Zhu et al.

(10) Patent No.: US 8,822,119 B2
(45) Date of Patent: Sep. 2, 2014

(54) BICOMPONENT DEVELOPING AGENT

(75) Inventors: Shunquan Zhu, Wuhan (CN); Yubin Wang, Wuhan (CN)

(73) Assignee: Hubei Dinglong Chemical Co., Ltd., Wuhan (CN)

( * ) Notice: Subject to any disclaimer, the term of this patent is extended or adjusted under 35 U.S.C. 154(b) by 0 days.

(21) Appl. No.: 13/178,496

(22) Filed: Jul. 8, 2011

(65) Prior Publication Data

US 2012/0295189 A1 Nov. 22, 2012

Related U.S. Application Data

(63) Continuation of application No. PCT/CN2011/075651, filed on Jun. 13, 2011.

(30) Foreign Application Priority Data

May 17, 2011 (CN) ..... 2011 1 0127206

(51) Int. Cl.
*G03G 9/08* (2006.01)

(52) U.S. Cl.
USPC ..... 430/108.6; 430/108.1; 430/108.3

(58) Field of Classification Search
USPC ..... 430/108.11, 110.3, 108.3, 108.1
See application file for complete search history.

(56) References Cited

U.S. PATENT DOCUMENTS

| | | | | |
|---|---|---|---|---|
| 2,297,691 | A * | 10/1942 | Carlson | 430/55 |
| 2005/0176919 | A1* | 8/2005 | Yamashiro | 528/272 |
| 2005/0260516 | A1* | 11/2005 | Tomita et al. | 430/110.3 |
| 2009/0047595 | A1* | 2/2009 | McDougall et al. | 430/137.14 |
| 2009/0226832 | A1* | 9/2009 | Zhu et al. | 430/105 |
| 2010/0135700 | A1* | 6/2010 | Mutoh et al. | 399/254 |
| 2010/0248119 | A1* | 9/2010 | Young et al. | 430/108.2 |
| 2011/0136056 | A1* | 6/2011 | Zhou et al. | 430/108.11 |

* cited by examiner

*Primary Examiner* — Mark F Huff
*Assistant Examiner* — Rashid Alam
(74) *Attorney, Agent, or Firm* — Matthias Scholl P.C.; Matthias Scholl

(57) ABSTRACT

A two-component developer including at least a toner and a carrier. The toner includes a coloring particle prepared by agglutinating and fusing a resin particle having colorants and a resin particle having wax, and 0.2-2.0 wt. % hydrophobic silica and 0.01-1.0 wt. % a hydrotalcite-like compound as external additives. A shape coefficient of the toner is 0.93-0.99. The carrier includes at least a magnetic particle coated with a silicone resin layer, with a volume average particle diameter of 20-100 μm.

11 Claims, No Drawings

BICOMPONENT DEVELOPING AGENT

CROSS-REFERENCE TO RELATED APPLICATIONS

This application is a continuation of International Patent Application No. PCT/CN2011/075651 with an international filing date of Jun. 13, 2011, designating the United States, now pending, and further claims priority benefits to Chinese Patent Application No. 201110127206.7 filed May 17, 2011. The contents of all of the aforementioned applications, including any intervening amendments thereto, are incorporated herein by reference.

BACKGROUND OF THE INVENTION

1. Field of the Invention

The invention relates to a two-component developer used in electrophotographic copiers and printers, and more particularly to a two-component developer with high visibility and excellent durability.

2. Description of the Related Art

In the field of xerography, a conventional two-component developer is prepared by mixing a toner with a carrier. Because of the application of the carrier, the toner is hence charged to develop images. Such method has been widely adopted at present.

A carrier is charged by friction with a toner, which also makes the toner charged. In other words, the carrier surface must be designed to be capable of generating charge with opposite polarity to the toner. Magnetic materials, as a core of carriers, can be either used as the carrier themselves for independent application or coated with a resin to carry charge. In the former case, although the carrier can be simply adjusted, it is harder than the toner made by resin since the carrier surface is made of magnetic materials. When carrier surface is attached with a toner, it may cause reduction of electrification. In addition, as the carrier surface state is restricted by magnetic materials, it would be difficult to control the electrification. Other problem such as humidity dependence would arise due to conductibility of the carrier surface. To solve the problems of solidness, magnetism, and conductibility when magnetic materials are used alone, resin-coated carriers have been widely applied recently.

For magnetic materials coating, different types of resins can be applied. However, in order to achieve excellent durability of the carrier, generally resins that are wearable and difficult to be attached by toner are much preferred, specifically silicone resin, which is characterized in that it has low critical surface tension and is uneasy to be attached by toner particles. Furthermore, as silicon resin is liable to form a crosslink structure, the surface thereof will become hardened and is uneasy to be worn.

On the other hand, in recent years, many proposals have been brought forward to develop a toner by polymerization methods. As particle diameter and shape of emulsion polymerization toner, made by resin particles agglutination and fusion-spheroidization, are easy to be adjusted, such toner has been gradually used in practice.

At present, resin/coloring particles agglomeration in an aqueous medium and fusion-spheroidization is the major method to make emulsion polymerization toner, which has a uniform particle surface and electrification. It is widely popular in terms of the electrification.

However, because of high uniform surface of emulsion polymerization toner, when it is combined with the silicone resin coating to make two-component developer, its triboelectric charging performance is worse and electrified capacity cannot be too high.

When silicone resin coating carrier is combined with toner made by pulverization method, there is no problem for triboelectric charging performance and electrified capacity. Such toner is obtained by using two-axis extruder to melt, mix, pulverize and classify resin and toner. As toner surface is formed by broken-out sections, its surface would be in a non-uniformity state, under which charge formed by friction with carrier will be polarized in non-uniformity part and easily electrified. However, if we use such toner, as crushing powder and ultrafine powder exist in pulverized toner, it is impossible to prevent carrier from being contaminated and lead to poor durability of electrification effect.

On the other hand, as silicone resin is composed of hydroxymethyl silicone resin, the resin is difficult to be separated due to its polar structure. Consequently, polarization effect is less during the friction between the silicone resin and surface with high uniformity. It would take a long time for triboelectric charging because of small electrification part.

SUMMARY OF THE INVENTION

In view of the above-mentioned problems, it is one objective of the invention to provide a two-component developer without disadvantages of the two-component developer composed of toner and a silicone resin carrier made by polymerization but with long-term triboelectric charging performance and long-term high-quality image development ability.

To achieve the above objective, in accordance with one embodiment of the invention, there is provided a two-component developer comprising at least a toner and a carrier, wherein the toner comprises a coloring particle prepared by agglutinating and fusing a resin particle having a colorant and a resin particle having wax, and as external additives 0.2-2.0 wt. % hydrophobic silica and 0.01-1.0 wt. % a hydrotalcite-like compound; a shape coefficient of the toner is 0.93-0.99; and the carrier comprises at least a magnetic particle coated with a silicone resin layer, with a volume average particle diameter of 20-100 μm. Preferably, the toner comprises the coloring particle prepared by fusing a polymer particle (A) and a polymer particle (B) in an aqueous medium, wherein the polymer particle (A) comprises paraffin wax inside and the polymer particle (B) comprises colorants.

Preferably, the silicone resin layer coating on the magnetic particle surface comprises 1-20 wt. % a charge control agent.

The toner, with a shape coefficient of 0.93-0.99, is prepared by adding 0.2-2.0 wt. % hydrophobic silica and 0.01-1.0 wt. % a hydrotalcite-like compound as external additives into the coloring particles comprising resin particles. The hydrotalcite-like compound can solve triboelectric charging restriction caused by surface uniformity of polymeric toner.

However, although specific cause of such improvement is still unclear, the following possible causes have been taken into account: hydrotalcite-like compounds prepared by divalent and tervalent metal ions are easy to maintain ionic properties. Such substance, existing on toner particle surface with certain amount, causes toner surface uniformity to decline to a certain extent and triboelectric charging position to increase. As a result, triboelectric charging performance is improved.

With respect to shape coefficient, by setting mean value of the shape coefficient to 0.93-0.99 and a non-spheroidal structure, poor image quality problem caused by surface shape non-uniformity and shape factor is solved.

In addition, the following formula shows the arithmetic mean value of the measured shape coefficient and preferred particle number is 5000-30000 when the arithmetic mean value is to be measured.

Shape coefficient (circularity)=circumference equal to particle projected area/perimeter of particle projection plane= $[2\times(A\times\pi)^{1/2}]/PM$.

(Wherein, A represents projected area of toner (i.e. toner particles), PM is perimeter of projection plane of toner (i.e. toner particles).

Specific data can be measured by FPIA3000 Flow particle image analyzer made by SYSMEX CORPORATION.

The hydrotalcite-like compound can be prepared by mixing a divalent and tervalent metal salt solution with an alkaline solution, and then they are obtained after coprecipitation of the divalent and tervalent metal salts solution, hence it is called coprecipitation method. During the coprecipitation process, the pH value will vary according to different combination and concentration of metal ions. The pH=10±2 is recommended for Mg—Al Aluminium Magnesium Carbonate compounds because when pH=10±2, Mg will not deposit. In case of high pH, Al will be dissolved again since aluminum hydroxide is an amphoteric compound. In coprecipitation method, we adopt a method to slowly drip mixed multiple metal salt solutions into alkaline aqueous solution to adjust pH to the above scope by adding sodium hydroxide aqueous solution. When Aluminium Magnesium Carbonate compounds are used in metal combination, it is not only limited to the binary system, tetravalent metal may also be included. If metal salt solution is mixed with different types of metal salts, it is also possible to synthesize polynary Aluminium Magnesium Carbonate compounds or such compounds containing tetravalent metal.

The hydrotalcite-like compound obtained from divalent and tervalent metal ions can be represented by the following chemical formula:

$$M^{II}_{8-x}M^{III}_{2}(A^{n-})_{z}mH_2O$$

In the above formula, $M^{II}$ represents divalent metal ions such as $Mg^{2+}$, $Fe^{2+}$, $Zn^{2+}$, $Ca^{2+}$, $Ni^{2+}$, $Co^{2+}$ and $Cu^{2+}$ while $M^{III}$ represents tervalent metal ions such as $Al^{3+}$, $Fe^{3+}$ and $Mn^{3+}$. A represents univalent or divalent anions comprising $OH^-$, $F^-$, $Cl^-$, $Br^-$, $NO^{3-}$, $CO_3^{2-}$, $SO_4^{2-}$, $CH_3COO^-$, $C_2O_4^{2-}$, $ClO_4^-$, and salicylic acid ion. X is a rational number from 2 to 4, n refers to 1 or 2, z is an integer below 22 when n=1 and below 11 when n=2, and m is a rational number below 10.

Specifically, the hydrotalcite-like compound is $Mg_6Al_2(OH)_{16}CO_3.4H_2O$, $Mg_{4.5}Al_2(OH)_{13}CO_3.3.5H_2O$, $Mg_{4.3}Al_2(OH)_{12.6}CO_3.H_2O$, $Mg_6Mn_2(OH)_{16}CO_3.4H_2O$, $Mg_6Fe_2(OH)_{16}CO_3.4H_2O$, and $Fe_6Al_2(OH)_{16}CO_3.4H_2O$.

Average initial particle diameter of the above hydrotalcite-like compounds measured using laser light scattering method is below 2 μm and preferably 10-1000 nm. If the particle diameter is too large, it is sometimes unable to exert electrification effect to toner; if the particle diameter is too small, it is sometimes unable to exert triboelectric effect due to enhanced adhesion to toner. In addition, when such hydrotalcite-like compounds are used as an external additive of the toner, the preferred amount is 0.01-1.0 wt. %. If the amount is too small, the triboelectric effect will not be exerted and if it is too large, the electrification effect will be reduced.

Toner used in the invention is at least a substance containing coloring particles agglutinated and thermally bonded with resin particles and added with external additives. In particular, the coloring particles used in the invention comprise polymer particles thermally bonded in an aqueous medium. If the coloring particles are obtained by thermally bonding polymer particles (A) containing paraffin wax and polymer particles (B) containing a colorant in aqueous medium, the effect would be more significant. By using such coloring particles, the paraffin wax and colorant are difficult to dissociate. If the two-component developer described in this invention is used, it can successfully solve the problem caused by attaching toner to the carrier and thereby ensures higher durability.

It is possible to conduct the following adjustment including but not limited to the aforementioned coloring particles.

To obtain the polymer particles (A) containing paraffin wax, seeded emulsion polymerization can be employed for paraffin wax. We can use any one type of well-known paraffin wax as the seed emulsion in this invention, specifically, chain hydrocarbon wax such as low-molecular-weight polyethylene, low-molecular-weight polypropylene, polyolefin copolymer; hydrocarbon wax such as paraffin wax or ceresin wax; long-chain aliphatic ester wax composed of pentaerythritol ester such as behenyl behenate, montanic acid ester, stearyl stearate; natural based wax such as palm wax and honey wax; higher aliphatic acid amide such as oleamide and octadecanamide. To improve fixation of the above paraffin wax, we recommend using the one with melting point lower than 100° C., preferably 40-90° C. and more preferably 60-85° C.

To use paraffin wax as the seed emulsion, we can disperse the above paraffin wax in an aqueous medium and meanwhile at least one type of surfactant has to be selected from known cationic surfactants, anionic surfactants, or non-ionic surfactants. Two or more types of those surfactants can be used at the same time. Specifically, Didodecyldimethylammonium Chloride, Didodecyldimethylammonium Bromide, Dodecyltrimethylammonium Bromide, Dodecylpyridinium Chloride, Dodecylpyridinum Bromide and Hexadecyltrimethylammonium Bromide can be used for cationic surfactants.

Some metal salt of higher aliphatic acid such as sodium stearate, sodium laurate, sodium dodecyl sulfate, sodium dodecyl benzene sulfonate, and sodium dodecyl sulfate can be used for anionic surfactants.

Polyoxyethylene decyl ether, hexadecyl polyoxyethylene ether (polyethyleneoxide ether), polyoxy ethrlene nonyl phinyl ether, polyoxyethylene laurel ether, sorbitan monooleate ethoxylate and mannose can be used for non-ionic surfactants.

Disperse these paraffin substances within surfactants water solution to form emulsion for seeded emulsion polymerization. Recommended average particle diameter of paraffin wax emulsion is 10-1000 nm, preferably 30-500 nm. In addition, the average particle diameter can be measured by BECKMAN COULTER LS230.

If average particle diameter of paraffin wax emulsion is greater than 1000 nm, then the average particle diameter of polymer particles obtained by seeded emulsion polymerization will become too large, which makes it difficult for particle diameter of toner to be narrowly distributed in the process of toner preparation. It is not recommended to use paraffin wax emulsion with large particle diameter if it is intended to prepare toner with small particle diameter. Moreover, if average particle diameter of paraffin wax emulsion is smaller than 10 nm, the paraffin wax content in polymer particles obtained by seeded emulsion polymerization is liable to become less. It would cause reduction of low-temperature storage effect.

There is no specific restriction regarding paraffin wax dispersion method. We hold that it is possible to use a device such as CLEARMIX to cut by high-speed rotation and disperse under cavitation effect or use TK homogeneous agitator to cut and disperse by high-speed rotation or use SC attrition mill or sand glider for dispersion.

In the presence of paraffin wax emulsion, polymer monomers are added each time into the emulsion for seeded emulsion polymerization. Free radical polymerization method is recommended to make paraffin wax particles into seed emulsion. Polymerization initiators can be added in advance into the paraffin wax emulsion or after the free radical polymerization monomer is added or after combination or through adding surfactants.

The free radical polymerization monomer used in the invention is selected from the group consisting of phenethylene, α-Methylstyrene, chlorostyrene, dichlorostyrene, p-tert-butylstyrene, p-n-butylstyrene, p-n-nonyl phenethylene, methacrylate, ethylacrylate, propyl methacrylate, butyl acrylate, isobutyl acrylate, 2-Hydroxyethyl acrylate, 2-Ethylhexyl acrylate, methacrylic acid methyl ester, methacrylic acid ethyl ester, methacrylic acid propyl ester, methacrylic acid n-butyl ester, methacrylic acid isobutyl ester, methacrylic acid hydroxyethyl ester, methacrylic acid ethyl, especially phenethylene and butyl acrylate.

A free radical polymerization monomer with polar groups can be used. As a free radical polymerization monomer with acid polar groups, we can use a free radical polymerization monomer having carboxyl groups or sulfonic groups such as acrylic acid, methacrylate, maleic acid, fumaric acid and cinnamic acid, especially acrylic acid and methacrylate.

As to a free radical polymerization monomer having alkalic polar groups, we can use a free radical polymerization monomer having N-heterocycle such as aminostyrene and hyamine groups, vinylpyridine and vinylpyrrolidone, ethenyl structured hyamine, acrylate containing amino groups (META) such as 2-(diethylamino group) ethyl methacrylate, acrylate containing amido hyamine group (META), especially acrylamide, N-Propyl acrylamide, N,N-Dimethyl acrylamide, N,N-Dipropyl acrylamide, N,N-Dibutyl acrylamide and acrylic amide.

These free radical polymerization monomers can be used individually or together with vitrification temperature preferably at 40-70° C. If the vitrification temperature is higher than 70° C., the stable temperature will become too high and paper fixation will become worse. If the vitrification temperature is lower than 40° C., toner's invariability will become worse during the storage, which would cause agglutination.

As to polymerization initiators, we can use persulfate water-soluble polymerization initiators such as potassium persulfate, sodium persulfate and ammonium persulfate; redox polymerization initiators composed of persulfate acid sulphite reducer, acid sodium sulfite reducer and ascorbic acid reducer; water-soluble polymerization initiators such as hydrogen peroxide, 4,4'-4,4'-Azobis (4-cyanovaleric acid), tert-Butyl hydroperoxid and cumyl hydroperoxide and redox polymerization initiators composed of those water-soluble polymerization initiator reducer, divalent iron salt reducer and ascorbic acid reducer. Those polymerization initiators can be added to the polymerization system at any time before or after or when the free radical polymerization monomers are added.

Chain transfer agents such as toluoylene diamine, n-dodecyl mercaptan, 2-mercaptoethanol, isopropyl xanthate, carbon tetrachloride and bromotrichloromethane may be used to adjust polymer molecular weight. They can be used individually or together with more than two of them, but at most 5 wt. % for free radical polymerization monomers. If too much chain transfer agents are used, some problems would occur, for example, molecular weight will be reduced, too many free radical polymerization monomers remains will be left or cause odor.

With respect to the proportion of paraffin wax and free radical polymerization monomers, if the free radical polymerization monomers are 100 phr, the paraffin wax will be 1-40 phr, recommended 2-35 phr and preferably 5-30 phr. If the paraffin wax is added too little, non-uniform phenomenon may emerge because of insufficient release during stabilization. If it is too much, it is easy to create an individual paraffin wax particle. The durability will be reduced when the carrier is attached by the paraffin wax.

Recommended average particle diameter of polymer particle (A) is within 50 nm-1500 nm, preferably 70-700 nm. The average particle diameter can be measured by BECKMAN COULTER LS230. If the average particle diameter is smaller than 50 nm, then the paraffin wax content will be reduced. In other words, the release effect will be reduced. If it is larger than 1500 nm, it would be difficult to control toner particle diameter, which will be distributed too wide.

Colorants included polymer particle (B) can be prepared in seed emulsion composed of colorants by means of polymerization.

When colorants used for seed emulsion are for polymerization, one (or more) type of inorganic/organic pigment or organic dyes can be used for such colorants. According to an embodiment of the invention, black colorants may also be used such as carbon black, magnetite, titanium black, aniline black, and aniline black dyes. In cyan colorants, we can use C.I. pigment blue 15:3 or C.I. pigment blue 15:4. For yellow colorants, it is recommended to use C.I. pigment yellow 14, C.I. pigment yellow 17, C.I. pigment yellow 93, C.I. pigment yellow 94, C.I. pigment yellow 138, C.I. pigment yellow 150, C.I. pigment yellow 155, C.I. pigment yellow 180, C.I. pigment yellow 185, C.I. solvent yellow 19, C.I. solvent yellow 44, C.I. solvent yellow 77 and C.I. solvent yellow 162. For red aniline dyes colorants, it is recommended to use C.I. pigment red 5, C.I. pigment red 48:1, C.I. pigment red 48:2, C.I. pigment red 48:3, C.I. pigment red 53:1, C.I. pigment red 57:1 and C.I. pigment red 122.

Those colorants are applied with resin binder with proportion of 3-2:100 phr.

Those colorants, same as the paraffin wax, are dispersible in aqueous medium when surfactants exist and used for emulsion polymerization. Recommended average particle diameter of a dispersed colorant is 50-1000 nm and preferably 80-500 nm. The average particle diameter can be measured by a digital mass flow meter (NIKKISO) and Micro-Trak UPA adjuster or BECKMAN COULTER LS230.

When the average particle diameter of a colorant is larger than 1000 nm, the average particle diameter of polymer particles obtained through seeded emulsion polymerization will become too large, which makes it difficult for particle diameter of toner to be narrowly distributed in the process of toner preparation and which is adverse to prepare toner with small particle diameter. If average particle diameter of the dispersed colorants is smaller than 50 nm, the colorants content in polymer particles after seeded emulsion polymerization is liable to be reduced, thus it will be difficult to maintain image concentration.

Colorants dispersion method is not specially restricted. We hold that it is possible to use a device such as CLEARMIX to cut by high-speed rotation and disperse under cavitation effect or use TK homogeneous agitator to cut and disperse by high-speed rotation or use SC attrition mill or sand glider for dispersion.

If colorant particles exist in seeded emulsion polymerization, it is recommended to use free radical polymerization method which adds free radical polymerization monomer into colorant dispersion solution in turn to make colorant particles into seed emulsion. At this point, polymerization initiators can be added in advance into the colorant dispersion solution or after the free radical polymerization monomer is added or after the combination or through adding surfactant.

With respect to surfactants, any one type of the surfactants can be used.

Apart from that, any one type of the free radical polymerization monomers or polymerization initiators can also be used.

To adjust molecular weight, we may add chain transfer agents or use the chain transfer agents.

Recommended average particle diameter of polymer particle (B) is 50 nm-1500 nm and preferably 70-700 nm. The average particle diameter can be measured by BECKMAN COULTER LS230. If the average particle diameter is smaller than 50 nm, a colorant will not be sufficiently admitted or the colorant itself dissociates; if it is larger than 1500 nm, toner's particle diameter will be difficult to be controlled and distributed too wide.

In addition, charge control agents can be added into the toner of in the invention. As an electrification control agent, it may be used individually or uses any type of known agents. Quaternary ammonium salt compound is an option for positive charge agents and for negative charge agents, we can use metal salts such as chrome, zinc and aluminium in salicylic acid or alkyl acid, metal chromium complex or diphenyl glycolic acid metal salt, metal chromium complex, amide compounds, phenolic compounds, naphthol compounds and phenol amide compounds. The consumption of above substances is determined by the expected electrified capacity of toner. But generally, the proportion between the consumption and resin binder is 0.01-10 phr: 100 phr, and preferably 0.1-10 phr: 100 phr.

With respect to agglutination method of polymer particle (A) containing paraffin wax and polymer particle (B) containing colorants, we can add agglutinating salt, heat and thermally bond polymer particles or use non-uniform agglutination method to firstly agglutinate and then heat, thermally bonded polymer particle (A) and polymer particle (B) after they are dispersed.

As to agglutinating salt, we can use univalent or multivalent metal salt, more specifically, for univalent salt, we can use sodium salt or sylvite such as sodium chloride or potassium chloride; for divalent salt, we can use magnesium chloride, magnesium sulfate, calcium chloride or calcium sulfate; for tervalent salt, we can use aluminium oxide or aluminum chloride.

When polymer particle (A) and polymer particle (B) are agglutinated, heated and thermally bonded, we can firstly add agglutinating salt below the vitrification temperature of the polymer particles and then raise the temperature quickly to above the vitrification temperature with speed preferably above 0.25° C./min within 1 h. Although there is no strict limit, it is better to control the temperature below 5° C./min as salting out reaction will be acute causing difficulties to control particle diameter. After the above process, polymer particles or any corpuscle will be salted out or thermally bonded. Afterwards, the dispersion solution with polymer particles (coloring particles) will be obtained.

Next step is to separate coloring particles from aqueous medium by filtering and cleaning. We can also use other methods including but not limited to centrifugal separation method, vacuum filtration method with aid of Buchner funnel, or filtration and cleaning method through a filter press.

The following step is to obtain dried coloring particles through a drying process. We recommend using parallel spray dryer, vacuum freeze dryer, or vacuum dryer, preferably stationary dryer, movable dryer, fluidized-bed dryer, rotating dryer, or agitated dryer. Water content of dried coloring particles is better below 5 wt. %, preferably 2 wt. %. In addition, if dried coloring particles agglutinate with each other because of attraction among weak particles, pulverization method may be applied by using a jet pulverizer, Henschel mixer, coffee mill or food processor for mechanical pulverization.

Mixing ratio of polymer particle (A) and polymer particle (B) is the mass ratio, i.e. polymer particle (A): polymer particle (B)=1:0.5-1.2, preferably polymer particle (A):polymer particle (B)=1:0.6-1.0. Within such range, separation ability and coloring power will be guaranteed. If polymer particle (A) accounts for a lower ratio, the separation ability will be affected. If it accounts for a larger ratio, toner's flowability will decrease, so does the coloring power.

In the invention, to obtain polymer particles, we use a charge control agents as seeds together with paraffin wax by dissolving or dispersing them into a monomer or paraffin wax. It is better to agglutinate charge control agent particles at the time of agglutinating the polymer particles to form aggregating particles, used for toner. We may use charge control agents in water as dispersion solution with average particle diameter 10-1000 nm. Charge control agents can be added and agglutinated when we carry out agglutination between polymer particles containing paraffin wax and polymer particles containing colorants.

When we make toner used in the invention, we may add the same or different types of resin binder emulsion when particle diameter of an aggregating particle is increased to the same diameter of a toner particle. After the emulsion attaches to particle surface, it will improve toner properties nearby.

In the invention, apart from aforementioned hydrotalcite-like compounds, we need to at least add 0.2-2.0 wt. % hydrophobic silica with average particle diameter 5-100 nm and hydrophobic degree over 50, measured by molecular weight methods. Hydrophobic silica can be obtained by surface processing of hydrophilic silicon dioxide such as dichlorodimethylsilane, hexamethyldisilazane and trichlorooctyl-Silane.

With respect to toner used in the invention, we can also use inorganic micro-powder such as magnetite, ferrite, ceria, strontium titanate, hydrophobic titanium dioxide, conductive titanium dioxide, or styrene resin, acrylic resin and lubricants as external additives. The consumption of these external additives is selectable based on expected performance. Generally, when resin adhesive is 100 phr of resin, the proportion of the external additives is approx. 0.05-10 phr.

The average particle diameter of the above additives is 10-1000 nm.

Carriers used in the invention at least have a silicone resin coating on the surface of each magnetic particle and whose volume-average particle diameter is 20-100 μm, preferably the magnetic particles whose surface is coated with silicone resin containing charge control agent.

With respect to magnetic particles, we can use known magnetic particles, preferably ferrite particles and more preferably ferrite particles containing light metal in consideration of adjustable magnetic angle and lightweighting of magnetic particles. Through miniaturization and lightening, internal pressure of developer will be reduced and the durability of the two-component developer will last longer.

Well-known ferrite particles can be used such as Cu—Zn ferrite, Ni ferrite, Ni—Zn ferrite, Mn—Mg ferrite, Cu—Mg ferrite, Mn ferrite, Mn—Zn ferrite, Li ferrite and Mn—Mg—Sr ferrite. For light metal ferrite, we can use alkali-earth metals or alkali metals containing Mg and Li.

Ferrite particles may be made by known methods. For example, we can firstly mix raw materials such as $Fe_2O_3$ or $Mg(OH)_2$ and then heat the mixed powder in a hot oven for presintering. When the pre-sintered substances are cooled down, pulverize them into approx. 1 μm particles in a vibratom and then add dispersant and water with powder to make bonding liquid. After that, ferrite particles will be obtained by wet grinding the bonding liquid in a wet ball mill to obtain a suspension and dry the suspension in a spray dryer.

Volume-average particle diameter of magnetic particles is 20-100 μm, preferably 20-80 μm and more preferably 30-60 μm. Magnetic particle diameter can be measured by HELOS.

When magnetic particles are measured by bridge method, the volume resistivity is better within 1×106−1×1011 Ω·cm. If such volume resistivity becomes low, exposure problem would occur due to induction phenomena. If the volume resistivity becomes high, then the opposite charge left on the carrier surface would be divided. Toner adhesion will become higher and image concentration will be reduced. The volume resistivity of a magnetic particle is preferably within 1×108−5×1010 Ω·cm.

For silicone resin, preferably we can use thermally hardened resin, which can be obtained from dehydrated condensation of hydric group connected with silicon atom.

With respect to thermohardening silicone available on the market, we can use silicone lacquer such as TSR115, TSR114, TSR102, TSR103, YR3061, TSR110, TSR116, TSR117, TSR108, TSR109, TSR180, TSR181, TSR187, TSR144, TSR165 (Toshiba Corporation) or KR271, KR272, KR275, KR280, KR282, KR267, KR269, KR211 and KR212 (Shin-Etsu Chemical).

To achieve crosslinking of thermally hardened silicone resin, it is required to conduct heat treatment (150-250° C.) or add catalytic hardener to such resin. For catalytic hardener, we can use octanoic acid, tetramethyl ammonium acetate, tetrabutyl titanate, tetraisopropyl titanate, dibutyl tin diacetate, dibutyltin oxide, dibutyltion dilaurate, γ-aminopropyltriethoxysilane, trimethoxysilyl propyl diethylenetriamine, silane coupler and N-[3-(dimethoxymethylsilyl)propyl]-2-ethanediamine.

For carriers used in the present to the invention, we also recommend adding charge control agent in a resin layer. Known charge control agent can be used. In order for the toner to possess positive charge, the carrier needs to maintain negative charge. Salicylic acid metal chromium complex or azo metal chromium complex are applicable. For example, DL-N22, DL-N23, DL-N24, DL-N32 and DL-N33 (Hubei Dinglong Chemical Co., Ltd) can be used.

In order for toner to possess negative charge, carrier is required to maintain positive charge. It is recommended to use quaternary ammonium salt charge control agent.

It is better for quaternary ammonium salt represented in formula (1) to contain the one represented in formula (2) or one or more types of quaternary ammonium salts represented in formula (2). The quaternary ammonium salt replaced by alkyl or aryl has excellent dispersion to silicone resin and high charge adjustment effect.

(1)

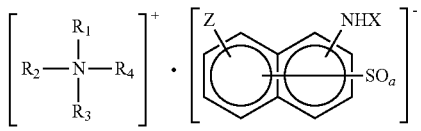

(In formula (1), X represents alkyl, cycloalkyl, replaced or non-replaced phenyl, or —$COR_5$ ($R_5$ represents lower alkyl); Z represents hydrogen atom, hydroxyl or alkyl; $R_1$ and $R_3$ represents alkyl or benzyl with carbon number 1-18, respectively; $R_2$ represents alkyl with carbon number 1-4 and $R_4$ represents alkyl or benzyl with carbon number 5-18), "lower alkyl" represents alkyl with carbon number 1-4.

(2)

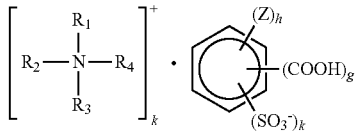

(In formula (2), Z represents hydrogen atom, hydroxyl, replaced or non-replaced alkyl, alkenyl or carboxyl; k represents an integer 1 or 2; g and h represents an integer 1-3 respectively; total number of k, g and h is smaller than 6. $R_1$-$R_4$ represents replaced or non-replaced alkyl with carbon number 1-18, alkenyl with carbon number 1-18, cycloalkyl, replaced or non-replaced phenyl or benzyl, respectively).

(3)

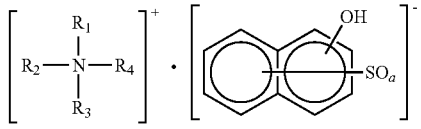

(In formula 3, $R_1$ represents alkyl with carbon number 1-8, $R_2$ and $R_3$ represents alkyl with carbon number 1-18, respectively and $R_4$ represents alkyl or benzyl with carbon number 1-8).

Example compounds in formula (1) are shown as follows.

(Compound 1)

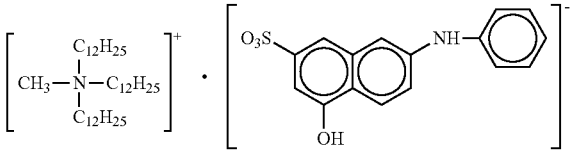

(Compound 2)

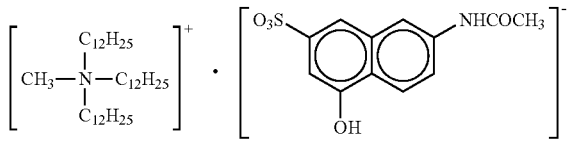

-continued (Compound 3)

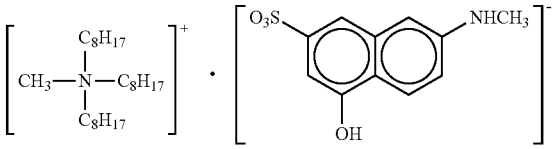

Example compounds in formula (2) are shown as follows.

(Compound 4)

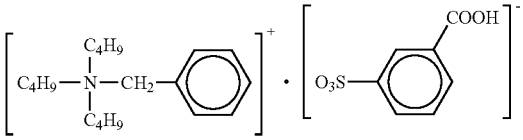

(Compound 5)

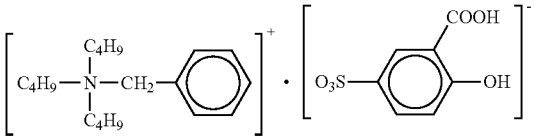

Example compounds in formula (3) are shown as follows.

(Compound 6)

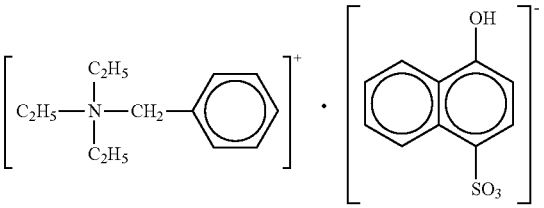

(Compound 7)

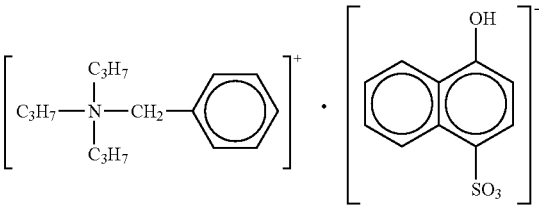

(Compound 8)

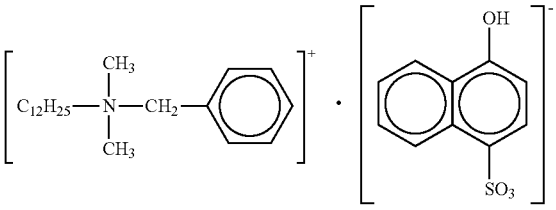

-continued (Compound 9)

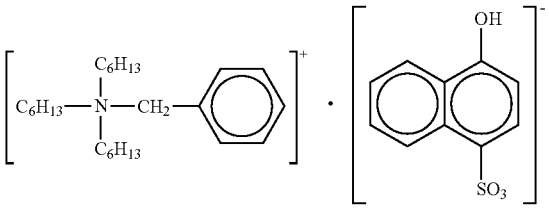

(Compound 10)

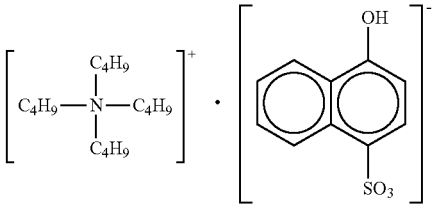

(Compound 11)

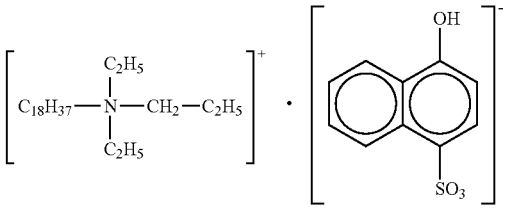

(Compound 12)

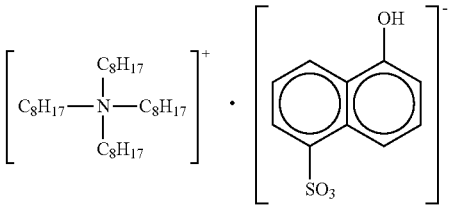

(Compound 13)

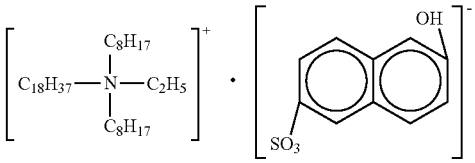

(Compound 14)

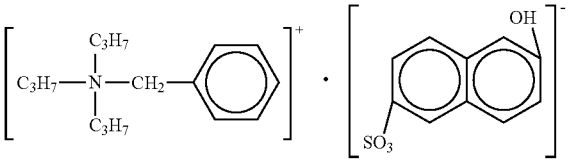

(Compound 15)

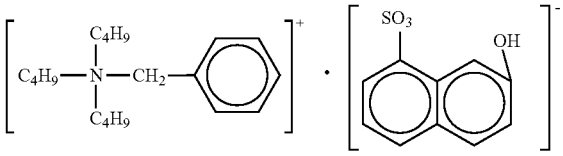

A silicone resin layer contains one or more types of the above quaternary ammonium salt. Under such high humidity environment, electrification ability will be stabilized, triboelectric charging of toner will be formed earlier and charge carried by toner will be prevented from reducing. Apart from that, it is effective to prevent carbon powder particles from attaching to carriers during long-term printing. Moreover, since the quaternary ammonium salt is colorless, it will be hard to contaminate toner so that color images will not be affected. A more stable image with certain concentration will be formed with long durability and meanwhile without giving you a fuzzy feeling.

Such carrier is to form a resin layer in accordance with the following principle.

In silicone resin layer formation method, some known methods may be adopted. For example, dissolve raw materials of the silicone resin layer into organic solvents such as toluene and acetone, then immerse magnetic particles into obtained solution and finally prepare magnetic particles of the encasing resin by using organic solvent evaporation impregnation method. In an oven, conduct thermohardening process to magnetic particles coated with resin to form a thermohardened silicone resin layer on the surface of the magnetic particles. Temperature for thermohardening process is better to be 5° C. higher than melting point of an electrification control agent but preferably lower than 70° C.

In order for encasing resin layer to contain charge control agent, it is possible to firstly add charge control agents at the time of applying resin coatings and then carry out coating.

It is better when covering amount of silicone resin covers 50-100% of a magnetic particle surface. If it is less than 50%, the magnetic particle will come out excessively. The exposed part would attract toner composition, which will affect durability. Furthermore, decreased carrier resistance would cause problems of development. Although there is no limit for covering amount, its average thickness is better not to exceed 1 μm.

With respect to the additive amount of charge control agents, it is better to add 1-20 phr into the encasing resin, recommended 5-10 phr. If the additive amount is too little, charge control agents will not function properly, if it is too much, the resistance of carriers is easy to decrease or cause problems for development.

Volume-average particle diameter of carriers used in the invention is 20-100 μm, recommended 20-80 μm and preferably 30-60 μm. If the volume-average particle diameter is too small, the carrier is liable to move to the photoreceptor from developing sleeve. It would cause bad transcription or sometimes white spot. If the volume-average particle diameter is too large, then it is easy for the carrier to cause scratched lines, and hence thin lines will appear or lattice repeatability will become low.

Saturation magnetization of the carrier is recommended within 30-100 emu/g and preferably within 50-80 emu/g. The lower the saturation magnetization, the softer of the developer's magnetic core brush connecting with a photoreceptor, and then a true image will be obtained compare with electrostatic latent image. If the saturation magnetization is too low, the carrier is liable to move to the photoreceptor. It would cause bad transcription and white spot. When the saturation magnetization is too high, the magnetic core brush will become hardened and it is easy for the carrier to cause scratched lines. Thin lines will then appear or lattice repeatability will become low.

DETAILED DESCRIPTION OF THE EMBODIMENTS

The invention is further explained in detail with the aid of embodiments.

Preparation of resin particles containing paraffin wax.

Preparation Example 1 of Resin Particles Comprising Paraffin Wax 15 g of 80° C. dissolved docosyl docosanoate is added into 100 g of 80° C. 5% sodium dodecyl benzene sulfonate aqueous solution. The resulting mixture is dispersed using a high speed disperser (CLEARMIX) until particle diameter reaches to 120 nm. Such particle diameter is measured by BECKMAN COULTER LS230. After the above dispersed solution is cooled, place it into a steel reactor equipped with an agitator, a heating/cooling system, a concentration device, and a material feeding mouth. Afterwards, the solution is heated to 40° C. and then 800 g of 5% sodium dodecyl benzene sulfonate aqueous solution and 1.2 g of potassium persulfate added. Raise the temperature to 85° C. and take one hour to drip a monomer solution comprising phenethylene 70 g, butyl acrylate 20 g, and isobutylene acid 10 g to carry out seeded emulsion polymerization with paraffin wax as the seed emulsion. After 7 hours, the reaction is terminated and cooled to 20° C. to measure the particle diameter. The diameter of a resin particle containing the paraffin wax is 210 nm, which is called polymer particle (A-1).

Preparation Example 2 of Resin Particles Comprising Paraffin Wax

According to Preparation Example 1 of resin particles comprising paraffin wax, resin particles comprising paraffin wax can also be obtained in the same manner as the example 1 except by adding docosyl docosanoate 20 g. The diameter of a resin particle containing paraffin wax is 220 nm, which we call polymer particle (A-2).

Preparation Example 3 of Resin Particles Comprising Paraffin Wax

According to Preparation Example 1 of resin particles comprising paraffin wax, resin particles comprising paraffin wax can also be obtained in the same manner as the example 1 except by adding docosyl docosanoate 25 g. The diameter of a resin particle containing paraffin wax is 250 nm, which we call polymer particle (A-3).

Preparation Example 4 of Resin Particles Comprising Paraffin Wax

According to Preparation Example 2 of resin particles comprising paraffin wax, resin particles comprising paraffin wax can also be obtained in the same manner as the example 2 except by adding refined carnauba wax 1# instead of the docosyl docosanoate with temperature at 85° C. when paraffin wax disperses. The diameter of a resin particle containing paraffin wax is 220 nm, which is called polymer particle (A-4).

Preparation of Resin Particles Containing Colorants

Preparation Example 1 of Resin Particles Comprising Colorants 16 g of carbon black is added into 100 g of 5% sodium dodecyl benzene sulfonate aqueous solution and the resulting mixture is dispersed using a high speed disperser (CLEARMIX) under 30° C. until average initial particle diameter reaches to 80 nm. Such particle diameter is measured by BECKMAN COULTER LS230. Afterwards, the above dispersed solution is placed into a steel reactor equipped with an agitator, a heating/cooling system, a concentration device, and a material feeding mouth. The steel reactor is heated to 30° C. and 800 g of 5% sodium dodecyl benzene sulfonate aqueous solution and 1.3 g of potassium persulfate added. When the temperature is raised to 85° C., take one hour to drip monomer solution comprising phenethylene 70 g, butyl acrylate 20 g, and isobutylene acid 10 g to carry out seeded emulsion polymerization with a colorant (i.e. carbon black) as the seed emulsion. After 7 hours, the reaction is terminated and the temperature is lowered to 20° C. to measure the particle diameter. The diameter of a resin particle containing such colorant (i.e. carbon black) is 160 nm, which is polymer particle (B-1).

Preparation Example 2 of Resin Particles Comprising Colorants

According to Preparation Example 1 of resin particles comprising colorants, resin particles comprising colorants can also be obtained in the same manner as the example 1 except by adding carbon black 20 g instead of 16 g. The diameter of a resin particle containing such colorant is 180 nm, which is polymer particle (B-2).

Preparation Example 3 of Resin Particles Comprising Colorants

According to Preparation Example 1 of resin particles comprising colorants, resin particles comprising colorants can also be obtained in the same manner as the example 1 except by adding C. I. Pigment Red 122 instead of the carbon black. The diameter of a resin particle containing such colorant is 210 nm, which is polymer particle (B-3).

Preparation Example 4 of Resin Particles Comprising Colorants

According to Preparation Example 1 of resin particles comprising colorants, resin particles comprising colorants can also be obtained in the same manner as the example 1 except by adding C. I. Pigment Yellow 74 instead of the carbon black. The diameter of a resin particle containing such colorant is 205 nm, which is polymer particle (B-4).

Preparation Example 5 of Resin Particles Comprising Colorants

According to Preparation Example 1 of resin particles comprising colorants, resin particles comprising colorants can also be obtained in the same manner as the example 1 except by adding C. I. Pigment Blue 15:3 instead of the carbon black. The diameter of a resin particle containing such colorant is 195 nm, which is polymer particle (B-5).

Preparation of Toner

Toner Preparation Example 1

The polymer particle (A-1) is mixed with the polymer particle (B-1), stirred under the temperature 30° and meanwhile 300 g of magnesium chlorate brine (concentration=20%) dripped within 30 min. The temperature is raised to 80° C. Afterwards, monitor the particle diameter growth. When the particle diameter (diameter in standard volume is measured by Cell Volume Tracing Analyzer II made by BECKMAN COULTER) reaches to 6.5 μm, 300 g of water is added to stop the growth. Raise the temperature to 95° C. and allow the shape to be changed into a sphere within 5 hours. When shape coefficient reaches to 0.965 (measured by FPIA-3000), the mixture is cooled down to 20° C. and then filtered using a centrifuge, washed with water, and vacuum dried. 200 g of dried particles are collected. 2 g of hydrophobic silica (processed by hexamethyldisilazane and average initial particle diameter=12 nm), 1 g of hydrophobic titania (processed by dodecamethyl-Cyclohexasilane and average initial particle diameter=25 nm), and 0.5 g of hydrotalcite-like compounds ($Mg_6Al_2(OH)_{16}CO_3.4H_2O$) are added to the dried particles and mixed using a Henschel mixer. The toner obtained is called toner 1 with shape coefficient 0.97 and volume-average particle diameter 6.5 μm.

Toner Preparation Example 2

According to toner preparation example 1, the toner can also be obtained in the same manner as the example 1 except by using the polymer particle (B-2) instead of the polymer particle (B-1). The toner obtained is called toner 2 with shape coefficient 0.97 and volume-average particle diameter 6.5 μm.

Toner Preparation Example 3

According to toner preparation example 1, the toner can also be obtained in the same manner as the example 1 except by using the polymer particle (A-2) instead of the polymer particle (A-1) and stop particle growth when particle diameter reaches to 6.9 μm, then cool it down when shape coefficient reaches to 0.955 and finally add hydrotalcite-like compounds 1.0 g. The toner obtained is called toner 3 with shape coefficient 0.96 and volume-average particle diameter 6.9 μm.

Toner Preparation Example 4

According to toner preparation example 1, the toner can also be obtained in the same manner as the example 1 except by using the polymer particle (A-3) instead of the polymer particle (A-1) and stop particle growth when particle diameter reaches to 6.0 μm, then cool it down when shape coefficient reaches to 0.975 and replace the hydrotalcite-like compounds with $Mg_4.5Al_2(OH)_{13}CO_3.3.5H_2O$ 0.1 g. The toner obtained is called toner 4 with shape coefficient 0.98 and volume-average particle diameter 6.0 μm.

Toner Preparation Example 5

According to toner preparation example 1, the toner can also be obtained in the same manner as the example 1 except by using the polymer particle (A-4) instead of the polymer particle (A-1) and replace the hydrotalcite-like compounds with $Mg_{4.3}Al_2(OH)_{12}.6CO_3.3.5H_2O$ 1.8 g. The toner obtained is called toner 5 with shape coefficient 0.97 and volume-average particle diameter 6.5 μm.

Toner Preparation Example 6

According to toner preparation example 1, the toner can also be obtained in the same manner as the example 1 except by using the polymer particle (B-3) instead of the polymer particle (B-1). The toner obtained is called toner 6 with shape coefficient 0.97 and volume-average particle diameter 6.5 μm.

Toner Preparation Example 7

According to toner preparation example 1, the toner can also be obtained in the same manner as the example 1 except by using the polymer particle (B-4) instead of the polymer particle (B-1). The toner obtained is called toner 7 with shape coefficient 0.97 and volume-average particle diameter 6.5 μm.

Toner Preparation Example 8

According to toner preparation example 1, the toner can also be obtained in the same manner as the example 1 except by using the polymer particle (B-5) instead of the polymer particle (B-1). The toner obtained is called toner 8 with shape coefficient 0.97 and volume-average particle diameter 6.5 μm.

Toner Preparation Example 9

According to toner preparation example 3, the toner can also be obtained in the same manner as the example 3 except by using the polymer particle (B-3) instead of the polymer particle (B-1). The toner obtained is called toner 9 with shape coefficient 0.97 and volume-average particle diameter 6.5 μm.

Toner Preparation Example 10

According to toner preparation example 3, the toner can also be obtained in the same manner as the example 3 except by using the polymer particle (B-4) instead of the polymer particle (B-1). The toner obtained is called toner 10 with shape coefficient 0.97 and volume-average particle diameter 6.5 μm.

Toner Preparation Example 11

According to toner preparation example 3, the toner can also be obtained in the same manner as the example 3 except by using the polymer particle (B-5) instead of the polymer particle (B-1). The toner obtained is called toner 11 with shape coefficient 0.97 and volume-average particle diameter 6.5 μm.

Toner Preparation Example 12

According to toner preparation example 4, the toner can also be obtained in the same manner as the example 4 except by using the polymer particle (B-3) instead of the polymer particle (B-1). The toner obtained is called toner 12 with shape coefficient 0.97 and volume-average particle diameter 6.5 μm.

Toner Preparation Example 13

According to toner preparation example 4, the toner can also be obtained in the same manner as the example 4 except by using the polymer particle (B-4) instead of the polymer particle (B-1). The toner obtained is called toner 13 with shape coefficient 0.97 and volume-average particle diameter 6.5 μm.

Toner Preparation Example 14

According to toner preparation example 4, the toner can also be obtained in the same manner as the example 4 except by using the polymer particle (B-5) instead of the polymer particle (B-1). The toner obtained is called toner 14 with shape coefficient 0.97 and volume-average particle diameter 6.5 μm.

Toner Preparation Example 15

According to toner preparation example 5, the toner can also be obtained in the same manner as the example 5 except by using the polymer particle (B-3) instead of the polymer particle (B-1). The toner obtained is called toner 15 with shape coefficient 0.97 and volume-average particle diameter 6.5 μm.

Toner Preparation Example 16

According to toner preparation example 5, the toner can also be obtained in the same manner as the example 5 except by using the polymer particle (B-4) instead of the polymer particle (B-1). The toner obtained is called toner 16 with shape coefficient 0.97 and volume-average particle diameter 6.5 μm.

Toner Preparation Example 17

According to toner preparation example 5, the toner can also be obtained in the same manner as the example 5 except by using the polymer particle (B-5) instead of the polymer particle (B-1). The toner obtained is called toner 17 with shape coefficient 0.97 and volume-average particle diameter 6.5 μm.

Comparative Toner Preparation Example 1

According to toner preparation example 1, a comparative toner can also be obtained in the same manner as the example 1 except by not using the hydrotalcite-like compounds. The toner obtained is called comparative toner 1 with shape coefficient 0.97 and volume-average particle diameter 6.5 μm.

Comparative Toner Preparation Example 2

According to toner preparation example 6, the comparative toner can also be obtained in the same manner as the example 6 except by not using the hydrotalcite-like compounds. The toner obtained is called comparative toner 2 with shape coefficient 0.97 and volume-average particle diameter 6.5 μm.

Comparative Toner Preparation Example 3

According to toner preparation example 7, the comparative toner can also be obtained in the same manner as the example 7 except by not using the hydrotalcite-like compounds. The toner obtained is called comparative toner 3 with shape coefficient 0.97 and volume-average particle diameter 6.5 μm.

Comparative Toner Preparation Example 4

According to toner preparation example 8, the comparative toner can also be obtained in the same manner as the example 8 except by not using the hydrotalcite-like compounds. The toner obtained is called comparative toner 4 with shape coefficient 0.97 and volume-average particle diameter 6.5 μm.

Preparation of Carrier

Carrier 1

20 g of silicone lacquers TSR115 is added into 1 Kg of Li—Mn ferrite particles with volume-average particle diameter 42 μm and 1000 mL of toluene is added into 1 g of compound 1 used as a charge control agent. The mixture is dried using a spray drying method to form a cover layer comprising the silicone lacquers and charge control agent on the surface of the ferrite particles and then heated under 190° C. for 1 h. After thermohardening treatment, a silicone-coated carrier containing the charge control agent is obtained. Such carrier is called carrier 1.

Carrier 2

According to carrier 1, the carrier can also be obtained in the same manner as the carrier 1 except by using 0.5 g of the compound 4 instead of the charge control agent. Such carrier is called carrier 2.

Carrier 3

According to carrier 1, the carrier can also be obtained in the same manner as the carrier 1 except by using 1.2 g of the compound 8 instead of the charge control agent. Such carrier is called carrier 3.

Carrier 4

According to carrier 1, the carrier can also be obtained in the same manner as the carrier 1 except by using the compound 15 instead of the charge control agent. Such carrier is called carrier 4.

Carrier 5

According to carrier 1, the carrier can also be obtained in the same manner as the carrier 1 except by not using the charge control agent. Such carrier is called carrier 5.

Comparative Carrier 1

A comparative carrier 1 can be obtained in the same manner as the carrier 1 except by using phenethylene-methyl methacrylate (phenethylene=30 phr; methyl methacrylate=70 phr) copolymer 50 g instead of the silicone lacquers TSR115 with charge control agents and heat treatment unrequired.

(Image Evaluation)

Use MX-4100 Digital Compound Copier (made by SHARP) with stencil style in the middle to carry out the image evaluation.

Combination of developers is as follows:

Mix the carriers with each toner in a V-mixer and use 8% developers to adjust toner concentration.

Developer combination example 1: carrier 1+toner 1/toner 6/toner 7/toner 8

Developer combination example 2: carrier 1+toner 2/toner 6/toner 7/toner 8

Developer combination example 3: carrier 1+toner 3/toner 6/toner 7/toner 8

Developer combination example 4: carrier 1+toner 4/toner 6/toner 7/toner 8

Developer combination example 5: carrier 1+toner 5/toner 6/toner 7/toner 8

Developer combination example 6: carrier 1+toner 3/toner 9/toner 10/toner 11

Developer combination example 7: carrier 1+toner 4/toner 12/toner 13/toner 14

Developer combination example 8: carrier 1+toner 5/toner 15/toner 16/toner 17

Developer combination example 9: carrier 2+toner 1/toner 6/toner 7/toner 8

Developer combination example 10: carrier 3+toner 2/toner 6/toner 7/toner 8

Developer combination example 11: carrier 4+toner 3/toner 9/toner 10/toner 11

Developer combination example 12: carrier 5+toner 4/toner 12/toner 13/toner 14

Comparative developer combination example 1: comparative carrier 1+toner 1/toner 6/toner 7/toner 8

Comparative developer combination example 2: comparative carrier 1+comparative toner 1/comparative toner 2/comparative toner 3/comparative toner 4

Use a full-color image formed by Y/M/C/B k 15% pixel ratio of each color under low temperature and humidity environment (10° C./10% RH). Print 10,000 pages of A4 paper without a stop to measure the image concentration, which can be evaluated by black toner images. Exposure concentration can be measured by reflection concentration.

In addition, in order to measure the color range of a full-color image, set up initial stage to 100 and calculate the color range area ratio after printing 10,000 pages continuously. The evaluation results are shown below:

| | Initial Stage | | After Printing 10,000 Pages | | |
|---|---|---|---|---|---|
| | Image Concentration | Coating Concentration | Image Concentration | Color Range (%) | Coating Concentration |
| Developer combination example 1 | 1.40 | 0.000 | 1.40 | 100% | 0.000 |
| Developer combination example 2 | 1.40 | 0.000 | 1.40 | 100% | 0.000 |
| Developer combination example 3 | 1.40 | 0.000 | 1.40 | 100% | 0.000 |
| Developer combination example 4 | 1.40 | 0.000 | 1.39 | 98% | 0.001 |
| Developer combination example 5 | 1.41 | 0.000 | 1.40 | 100% | 0.000 |
| Developer combination example 6 | 1.40 | 0.000 | 1.40 | 100% | 0.000 |
| Developer combination example 7 | 1.40 | 0.000 | 1.40 | 100% | 0.000 |
| Developer combination example 8 | 1.40 | 0.000 | 1.40 | 100% | 0.000 |

-continued

| | Initial Stage | | After Printing 10,000 Pages | | |
|---|---|---|---|---|---|
| | Image Concentration | Coating Concentration | Image Concentration | Color Range (%) | Coating Concentration |
| Developer combination example 9 | 1.40 | 0.000 | 1.39 | 99% | 0.001 |
| Developer combination example 10 | 1.41 | 0.000 | 1.40 | 100% | 0.000 |
| Developer combination example 11 | 1.40 | 0.000 | 1.40 | 100% | 0.000 |
| Developer combination example 12 | 1.40 | 0.000 | 1.36 | 97% | 0.003 |
| Comparative developer combination example 1 | 1.38 | 0.000 | 1.29 | 85% | 0.011 |
| Comparative developer combination example 1 | 1.36 | 0.000 | 1.25 | 79% | 0.013 |

According to different evaluation, if developers are not good enough, too much toner will be consumed. Consequently, we speculate that since replacement of toner would cause electrification delay, different problems would occur such as low image concentration, exposure, color imbalance, and narrow color reproduction range.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

The invention claimed is:

1. A developer, comprising:

a toner, said toner comprising a mixture of solid particles, said mixture of solid particles comprising a coloring particle and two additive particles, said two additive particles being a hydrophobic silica particle and an inorganic hydrotalcite analogue particle; and a carrier comprising a magnetic particle and a silicone resin layer, said silicone resin layer comprising a charge control agent;

wherein:

said two additive particles are external to said coloring particle;

said coloring particle is prepared by fusing first polymer particles and second polymer particles, wherein said first polymer particles comprise a wax and said second polymer particles comprise a colorant;

said two additive particles are present in the following weight percentages with respect to said toner: 0.2-2.0 wt. % of said hydrophobic silica particle and 0.01-1.0 wt. % of said inorganic hydrotalcite analogue particle;

said hydrophobic silica particle has an average particle diameter of between 5 and 100 nm;

said inorganic hydrotalcite analogue particle has an average particle diameter of between 10 and 1000 nm;

said toner has a shape coefficient of 0.93-0.99;

said magnetic particle is coated with said silicone resin layer;

said charge control agent is selected from salicylic acid metal complex, azo metal complex, and quaternary ammonium salt charge control agent; and said carrier has an average particle diameter of 20-100 μm.

2. The developer of claim 1, wherein the coloring particle is prepared by fusing polymer particles in an aqueous medium.

3. The developer of claim 1, wherein the coloring particle is prepared by fusing first polymer particles and second polymer particles in an aqueous medium, wherein said first polymer particles comprise wax inside and said second polymer particles comprise a colorant.

4. The developer of claim 2, wherein the coloring particle is prepared by fusing first polymer particles and second polymer particles in an aqueous medium, wherein said first polymer particles comprise wax inside and said second polymer particles comprise a colorant.

5. The developer of claim 1, wherein the silicone resin layer coating on the magnetic particle surface comprises 1-20 wt. % said charge control agent.

6. The developer of claim 2, wherein the silicone resin layer coating on the magnetic particle surface comprises 1-20 wt. % said charge control agent.

7. The developer of claim 1, wherein said inorganic hydrotalcite analogue particle is represented by the following chemical formula:

$$M^{II}_{8-x}M^{III}_{2}(A^{n-})_{Z}mH_2O$$

wherein $M^{II}$ represents a divalent metal ion, $M^{III}$ represents a tervalent metal ion, A represents a univalent or divalent anion selected from $OH^-$, $F^-$, $Cl^-$, $Br^-$, $NO_3^-$, $CO_3^{2-}$, $SO_4^{2-}$, and $ClO_4^-$, X is a rational number from 2 to 4, n refers to 1 or 2, z is an integer below 22 when n=1 and below 11 when n=2, and m is a rational number below 10.

8. The developer of claim 2, wherein said inorganic hydrotalcite analogue particle is represented by the following chemical formula:

$$M^{II}_{8-x}M^{III}_{2}(A^{n-})_{Z}mH_2O$$

wherein $M^{II}$ represents a divalent metal ion, $M^{III}$ represents a tervalent metal ion, A represents a univalent or divalent anion selected from $OH^-$, $F^-$, $Cl^-$, $Br^-$, $NO_3^-$, $CO_3^{2-}$, $SO_4^-$, and $ClO_4^-$, X is a rational number from 2 to 4, n refers to 1 or 2, z is an integer below 22 when n=1 and below 11 when n=2, and m is a rational number below 10.

9. The developer of claim 3, wherein a mixing mass ratio of said first polymer particles to said second polymer particles=1:0.5–1.2.

10. The developer of claim 4, wherein a mixing mass ratio of said first polymer particles to said second polymer particles=1:0.5–1.2.

11. A method for preparing the toner of claim 1, the method comprising:

1) performing an emulsion polymerization reaction on a mixture of an aqueous dispersion comprising wax and an aqueous dispersion comprising a monomer, and obtaining the first polymer particles comprising the wax therein;

2) performing an emulsion polymerization reaction on a mixture of an aqueous dispersion comprising a colorant and an aqueous dispersion comprising a monomer, and obtaining the second polymer particles comprising the colorant therein;

3) mixing and fusing the first polymer particles obtained in 1) and the second polymer particles obtained in 2) in an aqueous medium, and obtaining the coloring particles; and 4) mixing the coloring particles obtained in 3) with a hydrophobic silica particle and an inorganic hydrotalcite analogue particle, and obtaining the toner.

* * * * *